US005682787A

United States Patent [19]

Mukai

[11] Patent Number: 5,682,787

[45] Date of Patent: Nov. 4, 1997

[54] DIE ASSEMBLY FOR PLURAL KINDS OF WORKS

[75] Inventor: Jun Mukai, Toyota, Japan

[73] Assignee: Toyota Jidosha Kabushiki Kaisha, Japan

[21] Appl. No.: 679,019

[22] Filed: Jul. 12, 1996

[30] Foreign Application Priority Data

Jul. 14, 1995 [JP] Japan ..... 7-178794

[51] Int. Cl.[6] ..... B21D 37/02

[52] U.S. Cl. ..... 72/477; 72/413; 72/414

[58] Field of Search ..... 72/472, 477, 414, 72/413, 442, 415

[56] References Cited

U.S. PATENT DOCUMENTS

| | | | |
|---|---|---|---|
| 2,034,614 | 3/1936 | Franklin et al. | 72/414 |
| 3,987,721 | 10/1976 | Alexander et al. | 72/405 |
| 4,002,049 | 1/1977 | Randolph, Sr. | 72/388 |
| 4,126,936 | 11/1978 | Koller | 72/410 |
| 4,866,975 | 9/1989 | Hopkins | 72/477 |

FOREIGN PATENT DOCUMENTS

| | | | |
|---|---|---|---|
| 1 452 821 | 2/1971 | Germany . | |
| 2046527 | 3/1972 | Germany | 72/477 |
| 58-32528 | 2/1983 | Japan . | |
| 2-70329 | 3/1990 | Japan . | |
| 6-154864 | 6/1994 | Japan | 72/477 |

OTHER PUBLICATIONS

European Search Report dated Oct. 8, 1996 (2 pages).

*Primary Examiner*—David Jones
*Attorney, Agent, or Firm*—Finnegan, Henderson, Farabow, Garrett & Dunner, L.L.P.

[57] ABSTRACT

A die assembly for processing a plurality of different kinds of works each having a peculiar shape portion providing a peculiar shape and a common shape portion. A multiple face die which has a plurality of processing faces having different shapes each corresponding to the peculiar shape portion of each kind of work, is provided on a base relative to which each work can be positioned by utilizing the common shape portion thereof, such that it is operable to select one of the processing faces.

4 Claims, 5 Drawing Sheets

DIE ASSEMBLY FOR PLURAL KINDS OF WORKS

BACKGROUND OF THE INVENTION

1. Field of the Invention

This invention relates to a die assembly used for performing press operation on automotive door inner panels or like works. The works to be processed by the die assembly are classified into a plurality of different groups or kinds, while they each have a portion having a common shape to all kinds and a portion having a peculiar shape to each kind. For example, automotive door inner panels are classified into different kinds corresponding to respective different models, while they each have a common shape portion such as an inner trim mounting portion common to all kinds and a peculiar shape portion such as an edge hemming face peculiar to each kind. The present invention concerns a technique for carrying out a press operation on the peculiar portion of each kind of work for all kinds of works.

2. Description of the Prior Art

Heretofore, a plurality of peculiar die assemblies for the above press operation have been prepared for the respective different kinds of works. These die assemblies each have a press operation shape peculiar to each kind of work, and they are used selectively in conformity to the kind of work. This means that it is necessary to prepare die assemblies corresponding in number to the number of different kinds of works, thus increasing equipment cost. In addition, the die assembly replacement requires considerable time, that is, a considerably long time is needed for preparations before the press operation.

SUMMARY OF THE INVENTION

An object of the invention is to reduce equipment cost by permitting press operation on a plurality of different kinds of works to be done with a single die assembly.

Another object of the invention is to reduce time necessary for preparations prior to the press operation.

According to the invention, the above objects are attained by a die assembly which can be used in common for a plurality of different kinds of works. The works that are processed each include a portion having a common shape to all kinds of works and a portion having a peculiar shape to each kind of work. For each kind of work, the peculiar shape portion is processed in a peculiar press operation. The die assembly comprises a base and a multiple face die. The base can position a work in contact with the common shape portion of the work. The multiple face die is movable relative to the base, and it has a plurality of processing faces corresponding in number to the number of different kinds of works. Each processing face has a press operation shape peculiar to each kind of work. One of the processing faces of the multiple face die is set in an operating position in conformity to the kind of work to be processed.

With this die assembly, the works are each positioned with respect to the die assembly by utilizing their common shape portion. The plurality of processing faces of the multiple face die are used selectively. For example, a processing face for kind A is used for kind A of work, and a processing face for kind B is used for kind B of work. Each processing face has a press operation shape peculiar to each kind of work. Thus, every kind of work can be processed by merely selecting the corresponding processing face by moving the multiple face die.

In some cases, a common member is to be mounted on each of the works. Thus, each work may have a common shape in its common member mounting portion. In this case, it is suitable to have the common member (or a member having the same shape) secured to the base. With this arrangement, each work can be positioned by positioning its common member mounting portion with respect to the common member.

When the multiple face die is cylindrical in form, it is suitable to provide its outer periphery with a plurality of processing faces such that a selected one of the processing faces can be set in an operating position by rotating the cylindrical multiple face die. This arrangement permits reduction of the size of the die assembly as a whole.

The present invention will be more fully understood from the following detailed description and appended claims when taken with the accompanying drawings.

DETAILED DESCRIPTION OF THE PREFERRED EMBODIMENT

Figure 1:
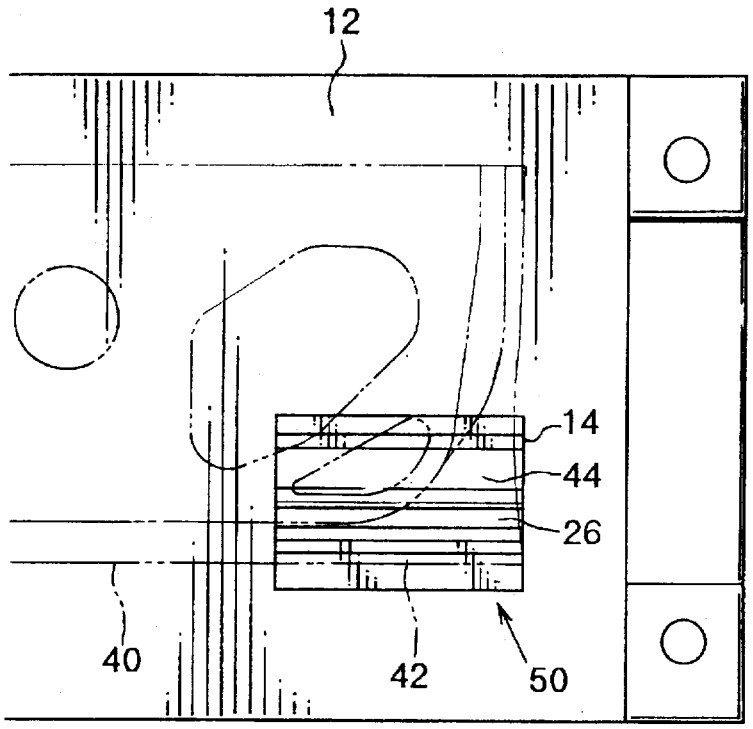
FIG. 1 is a plan view of a die assembly according to a preferred embodiment of the invention, showing the same in use.
Figure 2:
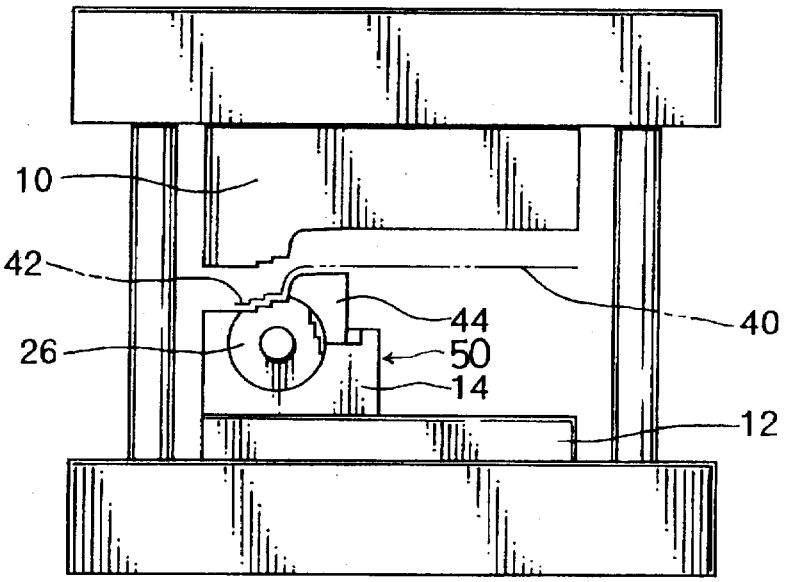
FIG. 2 is a right side view thereof.

An embodiment of the invention will now be described with reference to the drawings. FIG. 1 is a plan view of a die assembly 50 in use. FIG. 2 is a right side view of FIG. 1, in which the die assembly 50 is disposed between an upper die 10 and a lower die 12. The die assembly 50 is secured to the lower die 12. A work 40 is positioned on the die assembly 50. Then, the upper die 10 is lowered, so that pierce holes are press formed in a predetermined portion of the work 40 by piercing punches (not shown) of the upper die 10.

Figure 3:
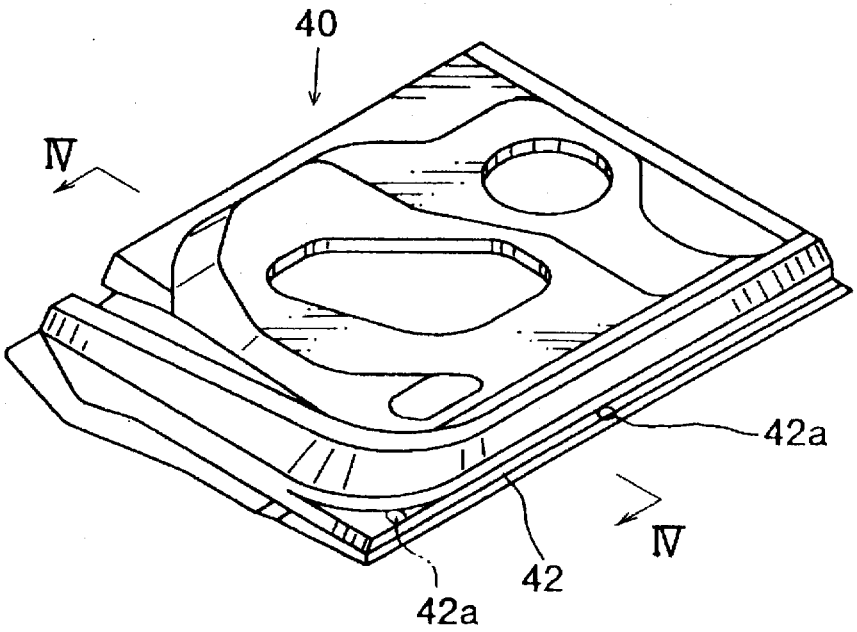
FIG. 3 is a perspective view of a work.
Figure 4:
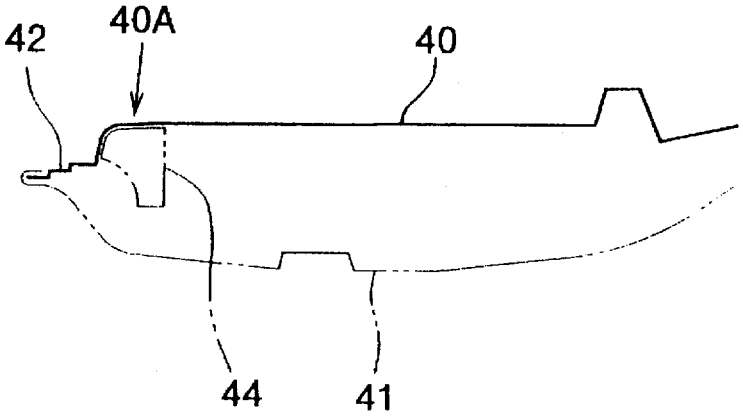
FIG. 4 is a sectional view taken along line A—A in FIG. 3.

FIG. 3 shows the outer shape of one kind of work 40, in perspective view, and FIG. 4 is a schematic sectional view taken along line A—A in FIG. 3. The work 40 shown in FIGS. 3 and 4 is an automotive door inner panel which is to be bonded to an outer panel 41. An inner trim mounting member 44 is bonded later to the inner panel 40 at a mounting portion 40A. Near the mounting portion 40A, the work 40 has a portion 42 in which the pierce holes are formed by the upper die 10 and the die assembly 50.

The portion 42 of the work 40 has a peculiar shape corresponding to the pertinent kind of work 40, i.e., to each of door inner panels of different models of vehicles. The inner trim mounting member 44, on the other hand, is common to all kinds of works 40. This common member 44 is mounted on the mounting portion 40A of the work 40. The mounting portion 40A has a common shape to all kinds of works. In FIG. 3, shown by a phantom line 42*a* in the portion 42 is the locality of press formation of the pierce hole.

Figure 5:
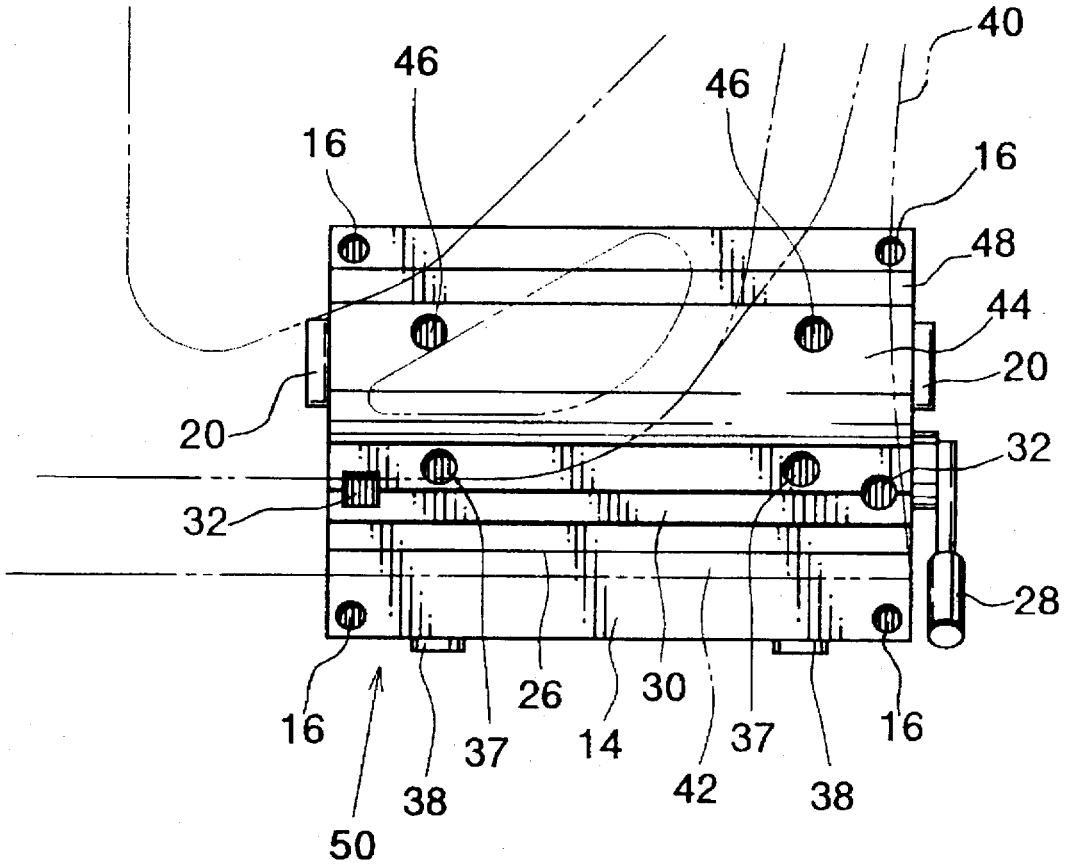
FIG. 5 is a plan view, to an enlarged scale, of the essential part of the die assembly shown in FIG. 1.
Figure 6:
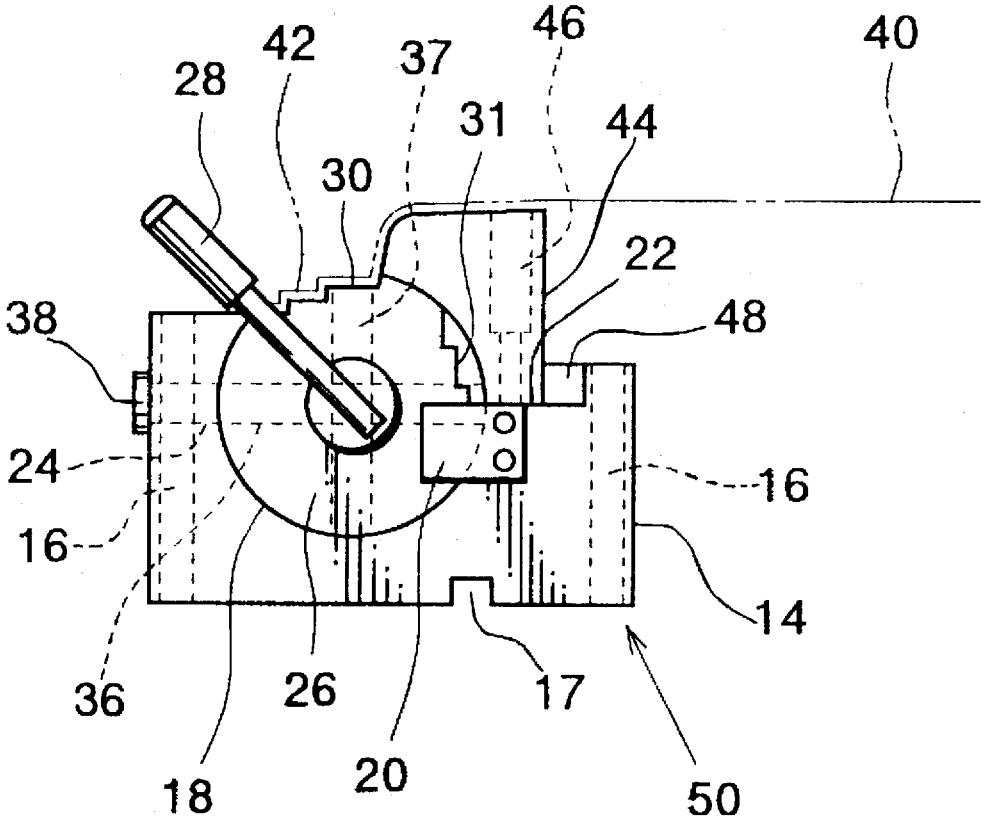
FIG. 6 is a side view of the part shown in FIG. 5.
Figure 7:
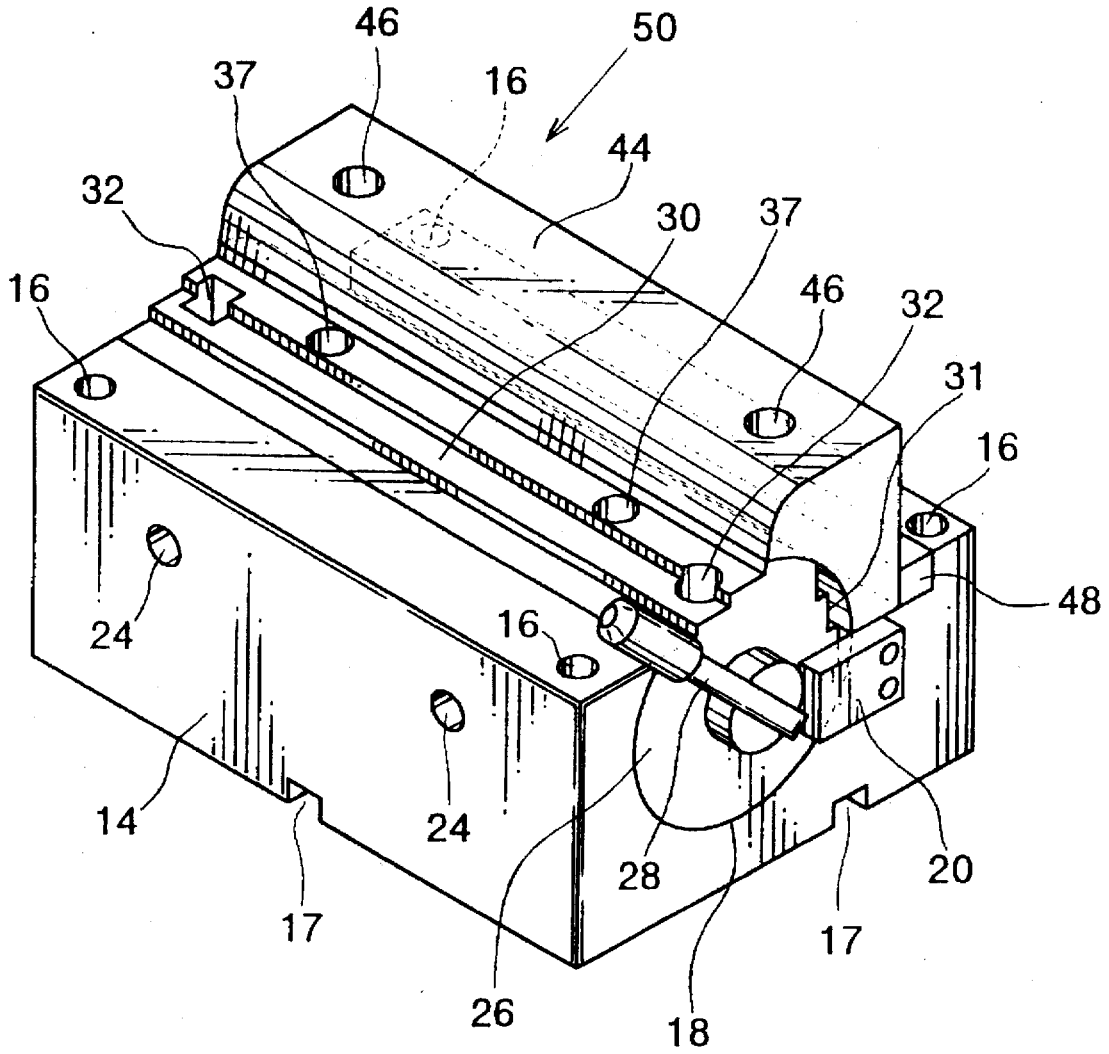
FIG. 7 is a perspective view of the part shown in FIGS. 5 and 6.

FIG. 5 is a plan view, to an enlarged scale, of the essential part of the die assembly 50 shown in FIG. 1. FIG. 6 is a side view of the part shown in FIG. 5. FIG. 7 is a perspective view of the part of the die assembly 50 shown in FIGS. 5 and 6. As shown in these drawings, a base 14 is secured to the lower die 12. The base 14 has four vertical through holes 16, and its bottom is formed with a positioning groove cross 17. The lower die 12 has its top formed with a positioning ridge cross (not shown). The base 14 is secured to the lower die 12 in a set position by engaging the positioning groove cross 17 and the positioning ridge cross, then inserting bolts (not shown) through the through holes 16 and tightening these bolts.

The base 14 has an arcuate sectional profile support recess 18 open to the top. A multiple face die 26 having a cylindrical shape is set such that its outer periphery is supported in the support recess 18 for rotation about its axis. A retainer 20 is bolted to each end face of the base 14 to prevent axial movement of the multiple face die 26.

The common part 44 which is to be mounted later on the work 40, is mounted on top of the base 14 by tightening pins 46 inserted through its holes (i.e., holes of the eventual product). The common member 44 has two functions, i.e., a function of positioning and setting the work 40 relative to the base 14 and a function of pushing and holding in position the outer periphery of the multiple face die 26 as is seen from FIGS. 6 and 7. It is possible to use a block exclusively for the function of pushing the multiple face die 26. In this case, the common member 44 is utilized for the sole purpose of positioning the work 40. A spacer 48 may, if necessary, be used to position the common member 44 with respect to the base 14. Since the common member 44 is secured to the base 14, any kind of work can be positioned and set with respect to the base 14.

As shown in FIGS. 6 and 7, the outer periphery of the multiple face die 26 has a plurality of different processing faces 30 and 31 which are spaced apart at a predetermined angular interval (i.e., substantially 90× in this embodiment) in the direction of rotation. The processing faces 30 and 31 each have a peculiar shape in correspondence to the work portion 42 which is peculiar in shape in correspondence to each kind of work 40. The processing faces 30 and 31 each have piercing holes 32 each provided near each end thereof to receive piercing punches (not shown) of the upper die 10 during piercing process. The piercing holes 32 of the processing face 31 are not shown.

The processing faces 30 and 31 need be provided only in the neighborhood of the piercing holes 32. Thus, the other portion of the multiple face die 26 (i.e., the intermediate portion thereof) may be of a circular profile of a reduced diameter so that it is free from interference with the work 40. This construction permits increase of the contact surface of the multiple face die 26 with the common member 44 that is mounted on the base 14 and the work 40.

A handle 28 is provided on the multiple face die 26 at an end thereof, and is operable to rotate the multiple face die 26. The multiple face die 26 has radial through positioning holes 36 and 37 in correspondence to the respective processing faces 30 and 31. These positioning holes 36 and 37 can be selectively aligned to lock pin insertion holes 24 which are formed in the base 14 such as to extend from the front surface of the base 14 toward the support recess 18. When the processing face 30, for instance, is selected and positioned to be at the top as shown, the positioning holes 36 corresponding to the processing face 30 is aligned to the lock pin insertion holes 24 in the base 14. In this state, the multiple face die 26 can be locked against rotation relative to the base 14 by inserting lock pins 38 as shown in FIGS. 5 and 6.

The pierce hole formation with the die assembly 50 thus constructed will now be described.

First, in a preparatory operation, the processing face 30 (or processing face 31) corresponding to the kind of the pertinent work 40, i.e., the shape of the portion 42, is positioned to be at the top by rotating the multiple face die 26 with the handle 28 after taking out the lock pins 38. In this state, the multiple face die 26 is locked to the base 14 by inserting the lock pins 38 into the positioning holes 36 of the multiple face die 26 corresponding to the processing face 30.

Then, a predetermined portion of the work 40 is engaged with the common member 44 mounted on the base 14 and complementary thereto in shape, so that the work 40 is positioned relative to the base 14. In this state, the portion 42 of the work 40 is positioned on top of the processing face 30 of the multiple face die 26, and the pierce hole formation localities as shown by phantom line **42*a* in FIG. 3 are coincident with the positions of the piercing holes 32 of the multiple face die 26. Then, the upper die 10 as shown in FIG. 2 is lowered, so that the pierce holes are formed in the portion 42 by the piercing punches (not shown) of the upper die 10 as described before. Scrap produced by this processing is led through the multiple face die 26 and the base 14 to be received by the lower die 12 shown in FIGS. 1 and 2** for disposal.

To change the processing face 30 over to the other processing face 31 in conformity to the kind of work 40, the lock pins 38 are taken out, and the processing face 31 is brought to the top position by rotating the multiple face die 26. Then, in this state, the lock pins 38 are inserted again through the lock pin insertion holes 24 of the base 14 into the positioning holes 37 of the multiple face die 26 corresponding to the processing face 31. By the above simple operation, the processing faces 30 and 31 of the multiple face die 26 can be selectively used in correspondence to the kind of work 40 (i.e., the shape of the portion 42 of work 40).

The change of the processing faces 30 and 31 can be automated by controlling the insertion and take-out of the lock pins 38 and the rotation of the multiple face die 26 by actuators, such as cylinders and motors.

While, in the above embodiment, the processing faces 30 and 31 have been described in relation to the case where they correspond to two kinds of works 40 different in the shape in the portion 42, respectively, they may correspond as well to two portions 42, respectively, having different shapes, of one kind of work 40. It is further possible to provide three or more processing faces 30 and 31 by reducing angular intervals between the processing faces of the multiple face die 26 and with respect to the direction of rotation. The operation of the multiple face die 26 for changing the processing faces 30 and 31 may be of sliding type as well, instead of the rotating type. In this case, a desired shape may be selected for the multiple face die 26.

The works 40 may not only be automotive door inner panels, and also the press operation on the work 40 may be a bent formation, etc., as well as the pierce formation.

While a preferred embodiment of the invention has been described, it will be appreciated that the following modifications may be made in the invention.

1. A die assembly characterized in that the operation of the multiple face die for selecting one processing face includes an operation of locking the multiple face die relative to the base or releasing the lock of the multiple face die.

2. A die assembly characterized in that the multiple face die can be locked relative to the base or released from the lock by inserting or taking out lock pins into or from the base and the multiple face die.

The multiple face die thus can be readily locked relative to the base or released from the lock, and also it can be held in a stable state of lock.

3. A die assembly characterized in that the multiple face die is a cylindrical member rotatably supported on the base and has a plurality of processing faces having different shapes formed on its outer periphery.

It is thus possible to relatively readily secure a plurality of processing faces and select the processing face in a simple operation.

4. A die assembly characterized in that the press operation is performed to form a pierce hole in a work.

While the invention has been described with reference to the preferred embodiment thereof, it is to be understood that modifications or variations may be easily made without departing from the scope of the present invention which is defined by the appended claims.

What is claimed is:

1. A die assembly for use with a plurality of different kinds of work pieces, each kind of work piece having a first shaped portion common to all of the different kinds of work pieces, and a second portion to be formed with a shape unique to each kind of work piece, the die assembly comprising:

a base portion having a positioning formation complementary in shape to the shaped portion common to all of the different kinds of work pieces; and a die movable relative to the base and having multiple forming faces corresponding in number to the plurality of different kinds of work pieces, each forming face having a shape complementing the respective second portions of the different kinds of work pieces, one of the multiple forming faces being set in an operating position for forming each kind of work piece;

whereby all of the kinds of work pieces may be positioned by the base portion in relation to the movable die for forming the second portions of each kind of work piece.

2. The die assembly of claim 1, wherein the positioning formation is fixed to the base in relation to the set operating position of the forming faces.

3. The die assembly of claim 1, wherein the die is of generally cylindrical shape and is rotatable relative to the base.

4. The die assembly of claim 3, including a locking pin extending radially through the die to set the die against rotation in an operating position.

* * * * *